US007573495B2

(12) United States Patent
Kanda

(10) Patent No.: US 7,573,495 B2
(45) Date of Patent: Aug. 11, 2009

(54) PIXEL CIRCUIT, LIGHT-EMITTING DEVICE, AND IMAGE FORMING APPARATUS

(75) Inventor: Eiji Kanda, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 797 days.

(21) Appl. No.: 11/204,989

(22) Filed: Aug. 17, 2005

(65) Prior Publication Data

US 2006/0066529 A1 Mar. 30, 2006

(30) Foreign Application Priority Data

Sep. 29, 2004 (JP) ..... 2004-283644

(51) Int. Cl.
*B41J 2/435* (2006.01)
*B41J 2/47* (2006.01)

(52) U.S. Cl. ..... 347/237; 347/247

(58) Field of Classification Search ..... 347/237, 347/238, 247; 345/82, 98; 257/500
See application file for complete search history.

(56) References Cited

U.S. PATENT DOCUMENTS 4,885,628 A * 12/1989 Nagai et al. ..... 257/500
6,388,695 B1 5/2002 Nagumo
6,400,349 B1 * 6/2002 Nagumo ..... 345/82
6,628,259 B2 * 9/2003 Hashimoto ..... 345/98
6,661,397 B2 12/2003 Mikami et al.
6,765,549 B1 7/2004 Yamazaki et al.
7,042,447 B2 5/2006 Numao

FOREIGN PATENT DOCUMENTS

| | | |
|---|---|---|
| JP | A-63-3476 | 1/1988 |
| JP | A-4-173350 | 6/1992 |
| JP | A-11-170601 | 6/1999 |
| JP | A 11-274569 | 10/1999 |
| JP | A-2000-108407 | 4/2000 |
| JP | A 2001-222256 | 8/2001 |
| JP | A 2002-297095 | 10/2002 |
| JP | A-2003-16129 | 1/2003 |
| JP | A-2003-150133 | 5/2003 |
| JP | A 2004-198683 | 7/2004 |
| JP | 2004-302400 A | 10/2004 |
| TW | 575762 A | 2/2004 |

* cited by examiner

*Primary Examiner*—Hai C Pham
(74) *Attorney, Agent, or Firm*—Oliff & Berridge, PLC

(57) ABSTRACT

A pixel circuit includes a light-emitting element which emits light having the intensity corresponding to an amount of a driving current; a driving transistor which supplies the driving current to the light-emitting element; a storing circuit which writes a data signal instructing the light-emitting brightness of the light-emitting element during a writing period of time to store the data signal; and a buffer circuit which supplies a signal output from the storing unit to the driving transistor.

8 Claims, 10 Drawing Sheets

PIXEL CIRCUIT, LIGHT-EMITTING DEVICE, AND IMAGE FORMING APPARATUS

This application claims the benefit of Japanese Patent Application No. 2004-283644, filed Sep. 29, 2004. The entire disclosure of the prior application is hereby incorporated by reference in its entirety.

BACKGROUND

The present invention relates to a pixel circuit using a light-emitting element, which emits light having the intensity corresponding to an amount of the current, such as an organic light-emitting diode element, to a light-emitting device, and to an image forming apparatus.

Recently, next-generation light-emitting elements, which are an alternative to liquid crystal elements, such as an organic electroluminescent element and an organic light-emitting diode (hereinafter, simply referred to as 'OLED element') which are called as light-emitting polymer elements or the like have been of interest. An image forming apparatus using a line head, in which a plurality of OLED elements is provided in one line, as an exposing unit has been developed. In such a line head, besides the OLED element, a plurality of pixel circuits including transistors for driving the line head is disposed. Therefore, recently, the line head composed of the OLED elements arranged in one line has been proposed (for example, see Japanese Unexamined Patent Application Publication No. 11-274569).

Here, the plurality of pixel circuits are arranged in one direction, to which selection signals are supplied through common wiring lines and data signals are supplied through matrix wiring lines. When the selection signals become active, the data signals are supplied to the pixel circuit.

Meanwhile, in order to decrease the brightness variation of the OLED element due to the on-resistance variation of a driving transistor, the on-resistance of the driving transistor should decrease sufficiently compared to the resistance of the OLED element. The size of the driving transistor should be enlarged to make the on-resistance of the driving transistor small.

However, if a driving force of a driving circuit, which is located at a previous stage to supply a current to a gate of the driving transistor, is insufficient, it is impossible to sufficiently drive the driving transistor. Further, if the driving force is insufficient, it takes a long time to change electric potential of the gate. For this reason, the writing operation cannot be terminated within a predetermined period of time, which degrades the printing quality.

SUMMARY

An advantage of the invention is that it provides a pixel circuit, a light-emitting device and an image forming apparatus, capable of sufficiently driving a driving transistor.

According to an aspect of the invention, a pixel circuit includes a light-emitting element which emits light having the intensity corresponding to an amount of a driving current; a driving transistor which supplies the driving current to the light-emitting element; a storing circuit which writes a data signal instructing the light-emitting brightness of the light-emitting element during a writing period of time to store the data signal; and a buffer circuit which supplies a signal output from the storing unit to the driving transistor.

According to the structure, since the buffer circuit is provided between the storing circuit and the driving transistor, the driving transistor can be sufficiently driven even though the driving transistor is large in size. Further, the light-emitting element includes an organic light-emitting diode and an inorganic light-emitting diode, or the like.

Further, in the above-mentioned structure, it is preferable that, among transistors constituting the buffer circuit, the size of an output transistor used in an output stage thereof be smaller than the size of the driving transistor. In this case, since the size of the output transistor of the buffer circuit becomes small, the area of the circuit becomes small and a current consumption of the buffer circuit can be reduced. Here, the size of the transistor is set to W/L, when W is the width of the gate and L is the length thereof.

Further, in the above-mentioned structure, it is preferable that the size of the output transistor be set such that a rising time of an output signal of the buffer circuit is shorter than a period of time from a predetermined writing time to a next writing time. In this case, it is possible to reliably control on/off of the driving transistor. A rising time is a period of time for which a level of an output signal changes from 10 to 90%.

In addition, in the above-mentioned structure, it is preferable that the buffer circuit be composed of an inverter. In this case, the driving transistor is controlled by a binary signal.

Next, according to another aspect of the invention, a light-emitting device includes a plurality of the pixel circuits described above; a plurality of data lines which supplies the data signal to the plurality of pixel circuits; and a driving circuit which supplies a signal instructing the writing period of time to the storing circuit. According to the structure, since the above-described pixel circuits are used, the driving transistor is prevented from malfunctioning even though the size of the driving transistor is large. Therefore, the brightness variation of the light-emitting element is prevented, which greatly improves the quality of light-emission.

Further, in the above-mentioned structure, it is preferable that a main power line, which is branched into a first power wiring line and a second power wiring line at a connection point and supplies power signals, be further provided, and the first power wiring line be connected to each storing circuit and the second power wiring line be connected to each buffer circuit. The buffer circuit needs to flow a large current through the driving transistor in order to drive the driving transistor. But, this may cause changes in electric potentials of the power signal. According to the structure, since the power signals supplied to the storing circuit and the buffer circuit use the first power wiring line and the second power wiring line, respectively, it is possible to reduce the changes in electric potentials of the power signal in the storing circuit due to the current consumed in the buffer circuit.

Further, in the above-mentioned structure, it is preferable that the width of the first power wiring line be larger than that of the second power wiring line. In this case, the changes in the electric potential of the power signal supplied to the storing circuit can be suppressed, which further reduces the malfunction of the storing circuit to improve the reliability.

Further, in the above-mentioned structure, it is preferable that the buffer circuit and the driving transistor be connected to the same power line. In this case, it is possible to separate the powers of the buffer circuit and the storing circuit from each other. Further, in the above-mentioned structure, it is preferable that the changes in the potential of the power signal do not exceed a threshold value of the driving transistor.

Next, according to still another aspect of the invention, an image forming apparatus includes photoconductors on which images are formed by irradiation of light, and a head unit that forms the images by irradiating light onto the photoconductors. The above described light-emitting device is used in the head unit. Since the image forming apparatus utilizes the aforementioned light-emitting device in the head unit, it is possible to form high-quality images on the photoconductors. Such an image forming apparatus includes a printer, a copying machine, and a complex machine.

BRIEF DESCRIPTION OF THE DRAWINGS

The invention will be described with reference to the accompanying drawings, wherein like numbers reference like elements, and wherein.

DETAILED DESCRIPTION OF EMBODIMENTS

Hereinafter, preferred embodiments of the invention will be described with reference to the accompanying drawings.

Light-Emitting Device

Figure 1:
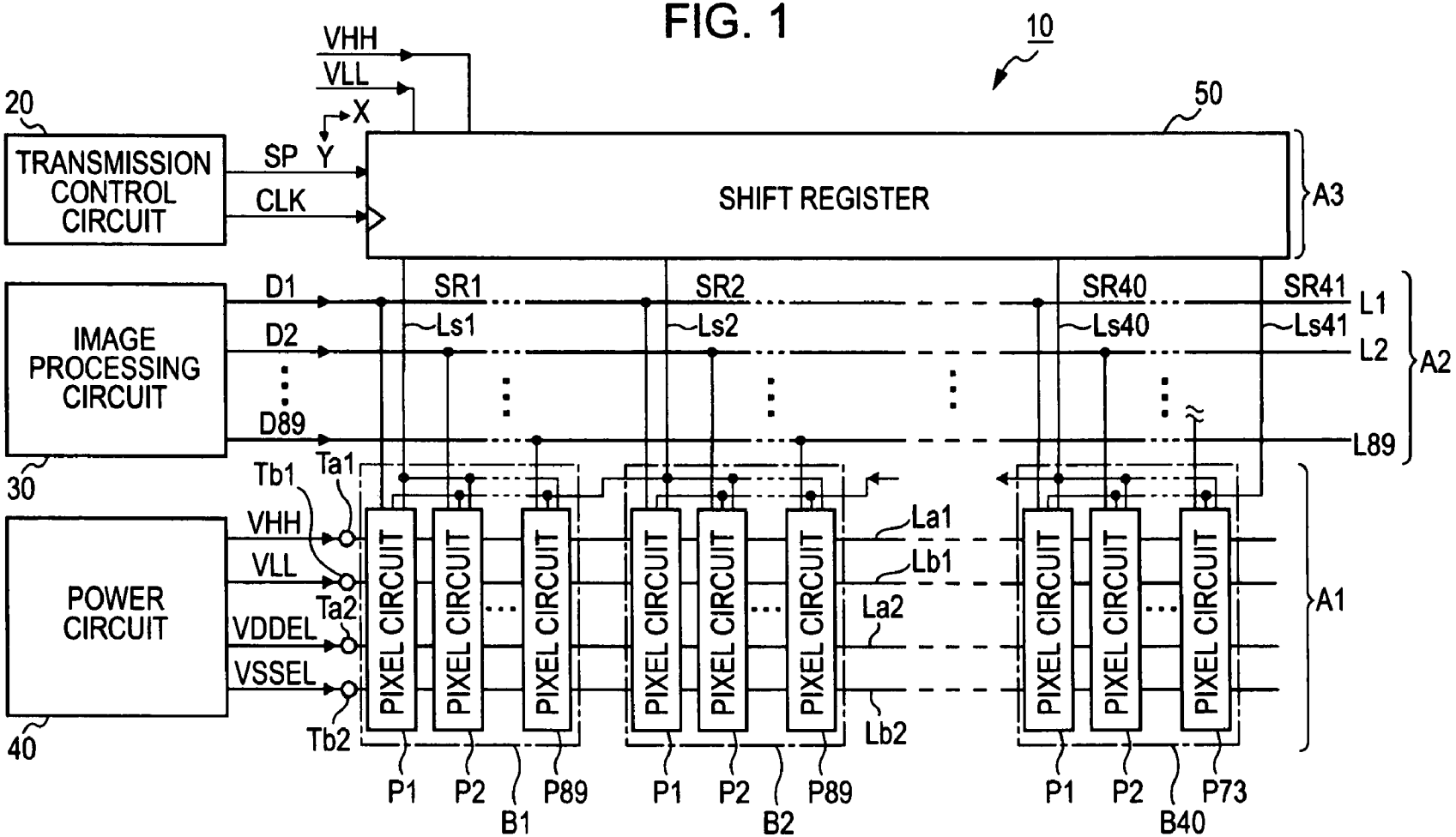
FIG. 1 is a block diagram showing a configuration of a light-emitting device of the invention.

FIG. 1 is a block diagram showing a configuration of a light-emitting device according to an embodiment of the invention. The light-emitting device includes a head unit 10 of a printer, serving as an image forming apparatus, and peripheral circuits around the head unit 10. Also, the light-emitting device includes a transmission control circuit 20, an image processing circuit 30, and a power circuit 40 as the peripheral circuits around the head unit 10. The transmission control circuit 20 generates a start pulse signal SP and a clock signal CLK. The start pulse signal SP becomes active when the main scanning period starts. The clock signal CLK provides a reference time for the main scanning. The image processing circuit 30 outputs data signals D1 to D89 which are parallel to one another. The data signals D1 to D89 of the embodiment are binary signals each of which instructs on/off of an OLED element. The power circuit 40 generates a first high-potential power signal VHH for a logic circuit, a first low-potential power signal VLL for a logic circuit, a second high-potential power signal VDDEL, and a second low-potential power signal VSSEL.

The head unit 10 is a line type optical head and includes areas A1 to A3. The area A1 is formed with pixel blocks B1 to B40, logic power lines La1 and Lb1, and driving power lines La2 and Lb2. The area A2 is formed with 89 data lines L1 to L89 and signal lines Ls1 to Ls40 which intersect the data lines. The area A3 is formed with a shift register 50. The pixel blocks B11 to B40 are arranged in an X direction. Further, the data lines L1 to L89, the logic power lines La1 and Lb1, and the driving power lines La2 and Lb2 are disposed parallel to the X direction.

Figure 2:
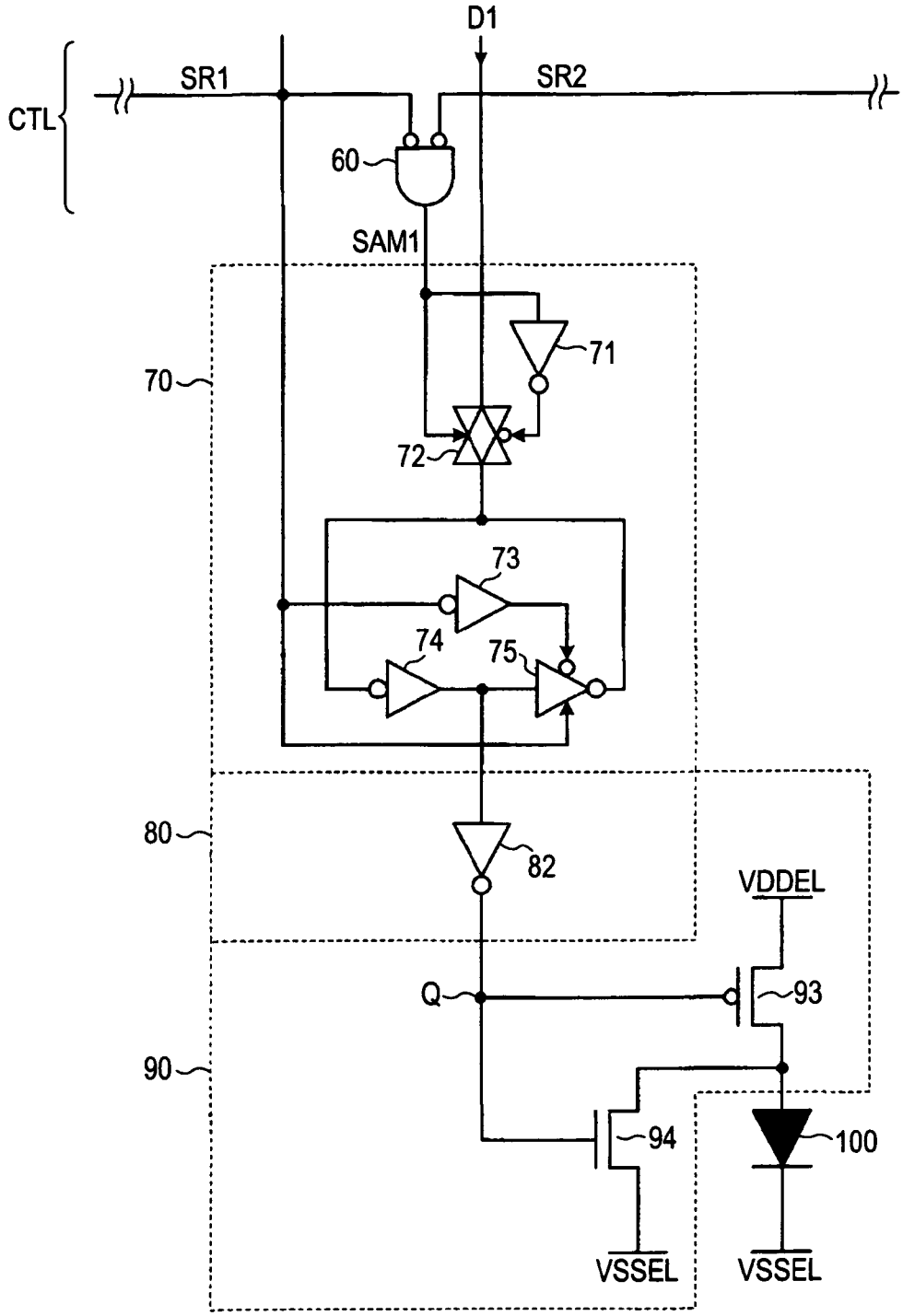
FIG. 2 is a circuit diagram of a pixel circuit of the light-emitting device.

The shift register 50 is constructed by cascade-connecting a plurality of unit shift circuits (not shown). The shift register 50 sequentially shifts the start pulse signal SP according to the clock signal CLK to generate shift signals SR1, SR2, . . . , and SR41. As shown in FIG. 2, each shift signal SR1 to SR41 is active only for one period of the clock signal CLK. In addition, the period of time for which adjacent shift signals are active overlaps during half the period of the clock signal CLK.

The shift signal SR1 to SR41 is supplied to the pixel blocks B1 to B40 via signal lines Ls1 to Ls 41. The respective pixel blocks B1 to B39 include 89 pixel circuits P1 to P89, and the pixel block B40 includes 73 pixel circuits P1 to P73. The pixel circuits P1 to P89 have the same configurations. In the following description, supposing that the respective pixel circuits do not matter, the pixel circuits P1 to P89 will be simply referred to as a pixel circuit P.

While the first high-potential power signal VHH is supplied to a supplying terminal Ta1 of the logic power line La1, the first low-potential power signal VLL is supplied to a supplying terminal Ta2 of the logic power line Lb1. While the second high-potential power signal VDDEL is supplied to a supplying terminal Ta2 of the driving power line La2, the second low-potential power signal VSSEL is supplied to a supplying terminal Tb2 of the power line Lb2. Each pixel circuit P is connected to the logic power lines La1 and Lb1 and to the driving power lines La2 and Lb2, through which various power signals are supplied thereto. The pixel block B1 is located nearest the supplying terminals Ta2 and Tb2, and the pixel block B40 is located farthest from the supplying terminals Ta2 and Tb2.

Figure 3:
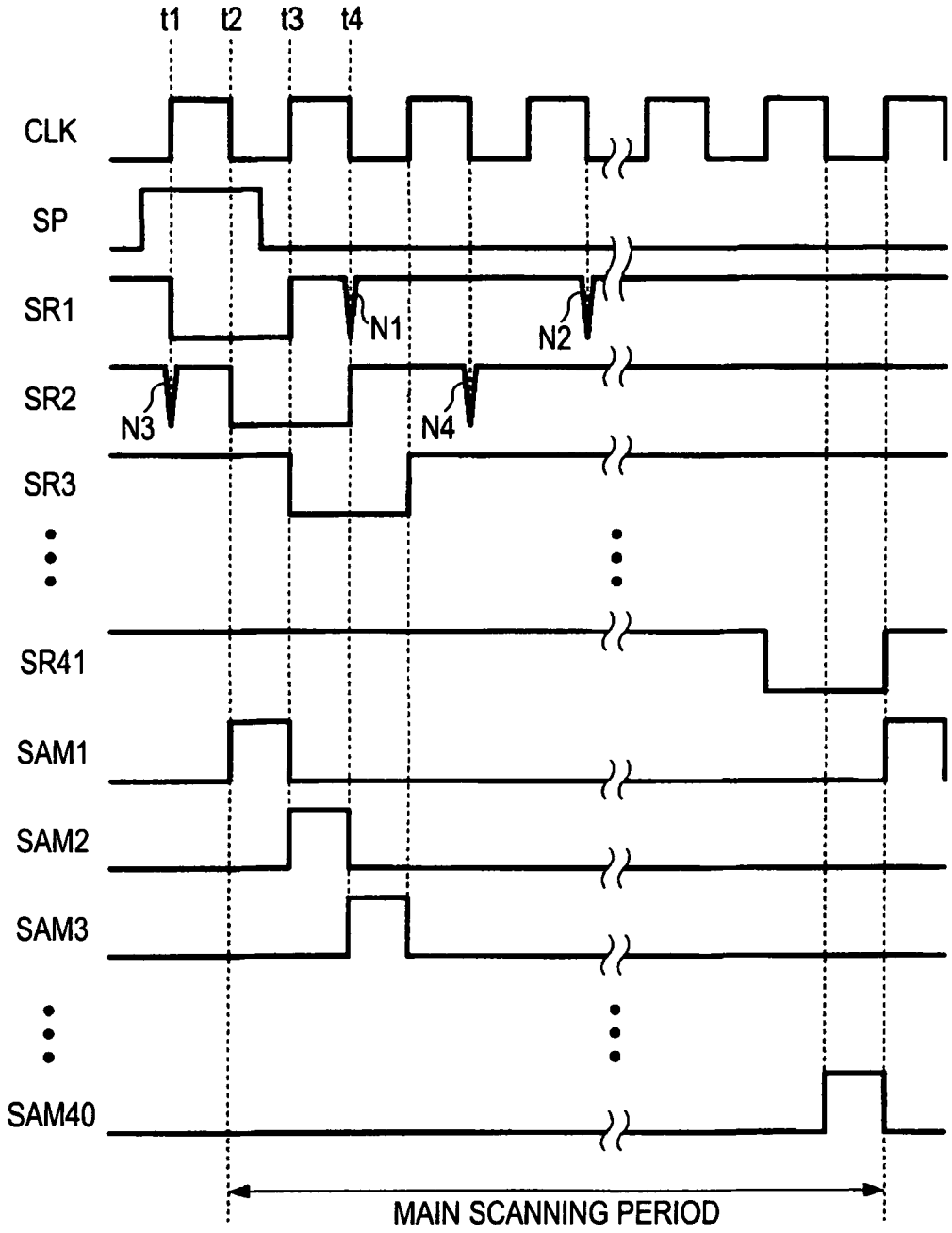
FIG. 3 is a timing chart in the pixel circuit.

FIG. 2 shows a configuration of the pixel circuit P in detail, FIG. 3 shows a timing chart of the pixel circuit. Further, it is supposed that the pixel circuit P is included in the first block B1 and is connected to the data line L1. The pixel circuit P includes a control circuit 60, a latch circuit 70, a buffer circuit 80, a supplying circuit 90, and an OLED element 100. The first high-potential power signal VHH and the first low-potential power signal VLL are supplied to the control circuit 60, the latch circuit 70, and the buffer circuit 80. The second high-potential power signal VDDEL and the second low-potential power signal VSSEL are supplied to the supplying circuit 90 and the OLED element 100.

The control circuit 60 has a function to generate a sampling signal based on a shift signal supplied from the shift register 50. The sampling signal designates a period of time for which data signals are written in the latch circuit 70. The control circuit 60 is constructed as a NOR circuit 61. The NOR circuit 61 generates a sampling signal SAM1 which becomes active (to high level) during a period of time for which a shift signal SR1 corresponding to the block B1 and a shift signal SR2 corresponding to the succeeding block B2 become concurrently active (to low level). At this moment, the shift signal SR2 becomes active after the shift signal SR1 has been active.

The reason why the control circuit 60 is provided in each pixel circuit P is as follows. The shift signal SR1 to SR41 is supplied to the pixel blocks B1 to B40 via the signal lines Ls1 to Ls41. Accordingly, noise is occasionally superposed on the signal lines Ls1 to Ls 41. One of the main reasons for the superposition is a noise in the A2 area. In the area A2, the signal lines Ls1 to Ls41 intersect the data signal lines L1 to L89, thus stray capacitance is added in the intersected part. In other words, the signal lines Ls1 to Ls 41 are coupled with the data signal lines L1 to L89 in an alternating current manner. Therefore, when logic levels of the data signals D1 to D89 change, noise of the signal lines Ls1 to Ls 41 is occasionally superposed thereon.

An example shown in FIG. 3 shows that noise N1 and N2 are superposed on the shift signal SR1 and that noise N3 and N4 are superposed on the shift signal SR2. For example, if the NOR circuit 61 is provided in the area A3 and sampling signals SAM1 to SAM40 are transmitted using the signal lines Ls1 to Ls40, noise is superposed on the sampling signals SAM1 to SAM40, which leads the pixel circuit P to malfunction.

However, since the NOR circuit 61 is disposed in the area A1 in the embodiment, it is possible to mask noise. That is, the NOR circuit 61 makes a sampling signal SAM1 active if only adjacent shift signals SR1 and SR2 are concurrently active. Therefore, while the noise N1 and N2 superposed on the shift signal SR1 is masked by the shift signal SR2, the noise N3 and N4 superposed on the shift signal SR2 is masked by the shift signal SR1.

Figure 4A:
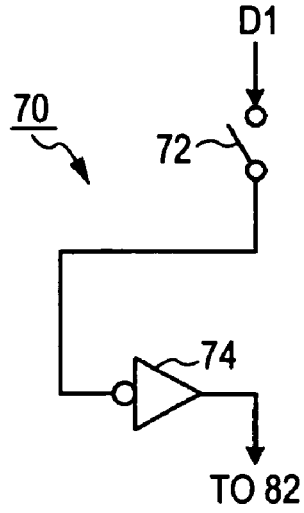
FIG. 4A is an equivalent circuit diagram of a latch circuit 70 used in the pixel circuit.

The NOR circuit 61 generates the sampling signal SAM1 which becomes at high level during a period of time t2 to t3 for which both shift signals SR1 and SR2 become at low levels (active) to supply the sampling signal SAM1 to the latch circuit 70. The latch circuit 70 includes a transfer gate 71, inverters 72 to 74, and a clocked inverter 75. Since the shift signal SR1 is at low level during the period of time t1 to t2, the clocked inverter 75 is in a high impedance state. Further, since the sampling signal SAM1 is at low level, the transfer gate 71 is in an off state. As a result, an equivalent circuit of the latch circuit 70 as shown in FIG. 4A is obtained.

Figure 4B:
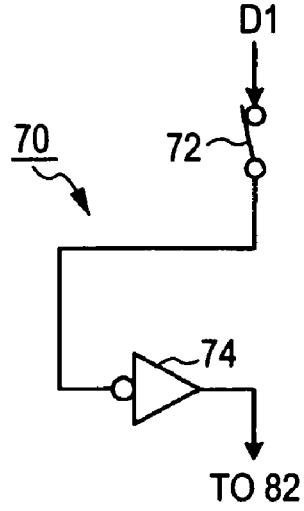
FIG. 4B is an equivalent circuit diagram of the latch circuit 70 used in the pixel circuit.

Next, although the shift signal SR1 is at low level during the period of time t2 to t3, the sampling signal SAM1 becomes at high level. At this moment, while the clocked inverter 75 remains in a high impedance state, the transfer gate 71 is in an on state. As a result, an equivalent circuit of the latch circuit 70 as shown in FIG. 4B is obtained, and a logic level of a data signal D1 is input.

Figure 4C:
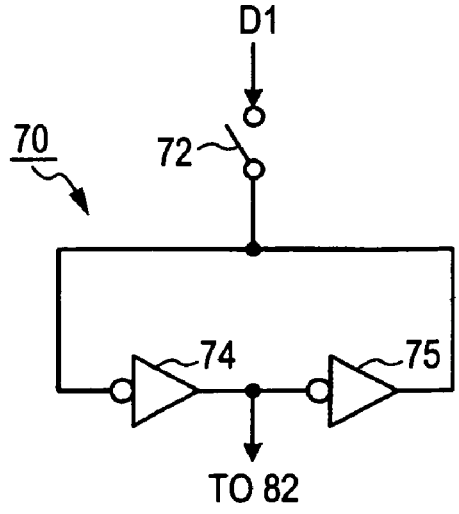
FIG. 4C is an equivalent circuit diagram of the latch circuit 70 used in the pixel circuit.

Next, the shift signal SR1 becomes at high level after time t4, and the clocked inverter 75 operates as an inverter. Since the sampling signal SAM1 is at low level, the transfer gate 71 is turned off. As a result, an equivalent circuit of the latch circuit 70 as shown in FIG. 4C is obtained. That is, the data signal D1 is not further supplied, and a logic level of the data signal D1 is stored in the latch circuit 70 until the next writing is performed.

An output signal of the latch signal 70 is supplied to the supplying circuit 90 via an inverter 82 serving as the buffer circuit 80. The supplying circuit 90 includes a driving transistor 93 and a control transistor 94. A gate of the driving transistor 93 and a gate of the control transistor 94 are connected to a node Q, and an output terminal of the inverter 82 is connected to the node Q. The driving transistor 93 is a P-channel type transistor, and the control transistor 94 is an N-channel type transistor. The second high-potential power signal VDDEL is supplied to a drain of the driving transistor 93, and an anode of the OLED element 100 is connected to a source thereof. The second low-potential power signal VSSEL is supplied to a cathode of the OLED 100. The OLED element 100 is short-connected by the control transistor 94 which is in an on state.

Here, when a logic level at the node Q is at low level, the driving transistor 93 becomes in an on state, and the control transistor 94 becomes in an off state. At this moment, a driving current is supplied to the OLED element 100 to make the OLED element 100 emit light. In the meanwhile, when a logic level at the node Q is at high level, the driving transistor 93 becomes in an off state, and the control transistor 94 becomes in an on state. At this moment, a driving current is not supplied to the OLED element 100 not to make the OLED element 100 emit light.

In the supplying circuit 90, a logic level at the node Q is allowed to change if a sampling signal SAM1 becomes active. The sampling signal SAM1 is generated in another pixel circuit P included in the block B1, in a similar manner. Therefore, the pixel circuits P1 to P89 included in the block B1 perform the writing operations at the same time. This is the same as in the other blocks B2 to B40. That is, the data signals D1 to D89 are written block by block according to the sampling signals SAM1 to SAM 40. As shown in FIG. 3, a period of time from a time when the sampling signal SAM1 becomes active to a time when the sampling signal SAM1 becomes active again is set to be a main scanning period.

It is necessary that on-resistance of the driving transistor 93 be sufficiently small compared to the resistance of the OLED element 100, in order to reduce the brightness variation of the OLED element 100 due to the on-resistance variation. The size of the driving transistor should be enlarged to reduce the on-resistance of the driving transistor. For this reason, gate currents should be sufficiently supplied to the driving transistor 93. Further, since the gate size of the driving transistor 93 becomes large, the capacitance of the gate increases as well. For example, when the node Q is driven in a circuit whose driving force is insufficient, the node Q is influenced by the capacitance of the gate, thus it may happen that a potential of the node Q does not exceed a threshold value of the driving transistor in the main scanning period. If this happens, the OLED element 100 emits light when it should not do, or does not emit light when it should do, which causes deterioration of the image quality. Taking this into account, the data signal D1 stored in the latch circuit 70 is supplied to the node Q via the inverter 82 in the embodiment. In other words, the inverter 82 functions as a reversing circuit as well as a buffer circuit which amplifies output currents. Therefore, the driving transistor 93 can be sufficiently driven.

Figure 5:
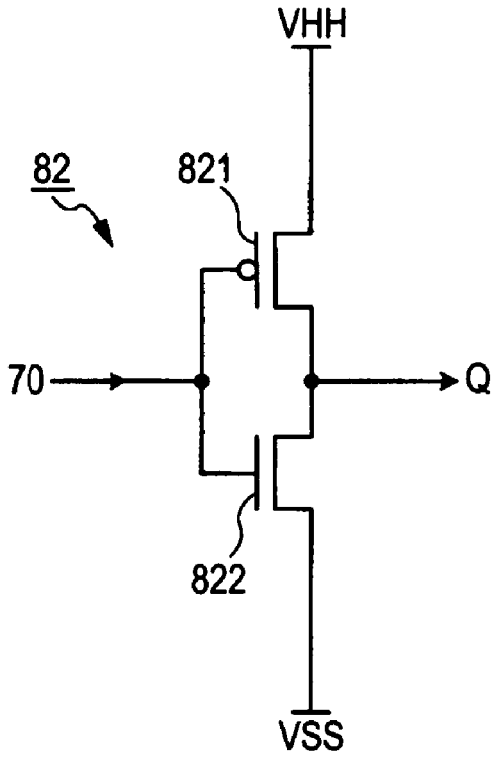
FIG. 5 is a circuit diagram of an inverter.
Figure 6:
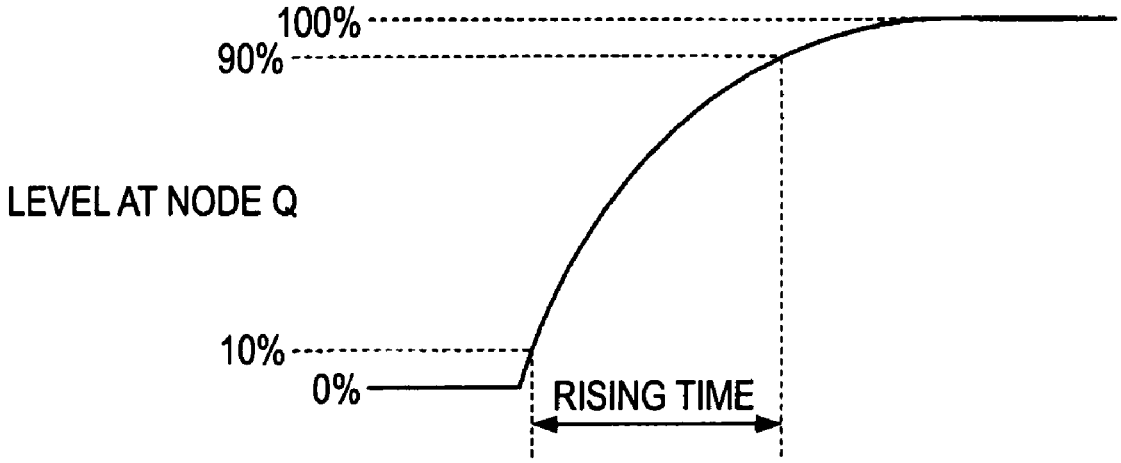
FIG. 6 is a waveform diagram at a node G for explaining a rising time.

FIG. 5 shows a circuit diagram of the inverter 82. The driving force of the inverter 82 is defined by the size of transistors 821 and 822. In this case, the size of the transistors 821 and 822 is set to be smaller than the size of the driving transistor 93 and to satisfy the following conditions. That is, the size of the transistors 821 and 822 is set such that a rising time of a signal waveform at the node Q is shorter than the main scanning period. Accordingly, it is possible to reliably make the OLED element 100 emit light. In addition, although the inverter 82 has been used as a buffer circuit in the embodiment, two inverters may be connected in series in a case in which a logic level is reverse. In this case, the size of the transistor in the final stage may be set such that a rising time of a signal waveform at the node Q is shorter than the main scanning period. The size of the transistor is set to W/L, when W is the width of the gate and L is the length thereof. Further, a rising time is a period of time for which a logic level at the node Q changes from 10% to 90%, as shown in FIG. 6.

Figure 7:
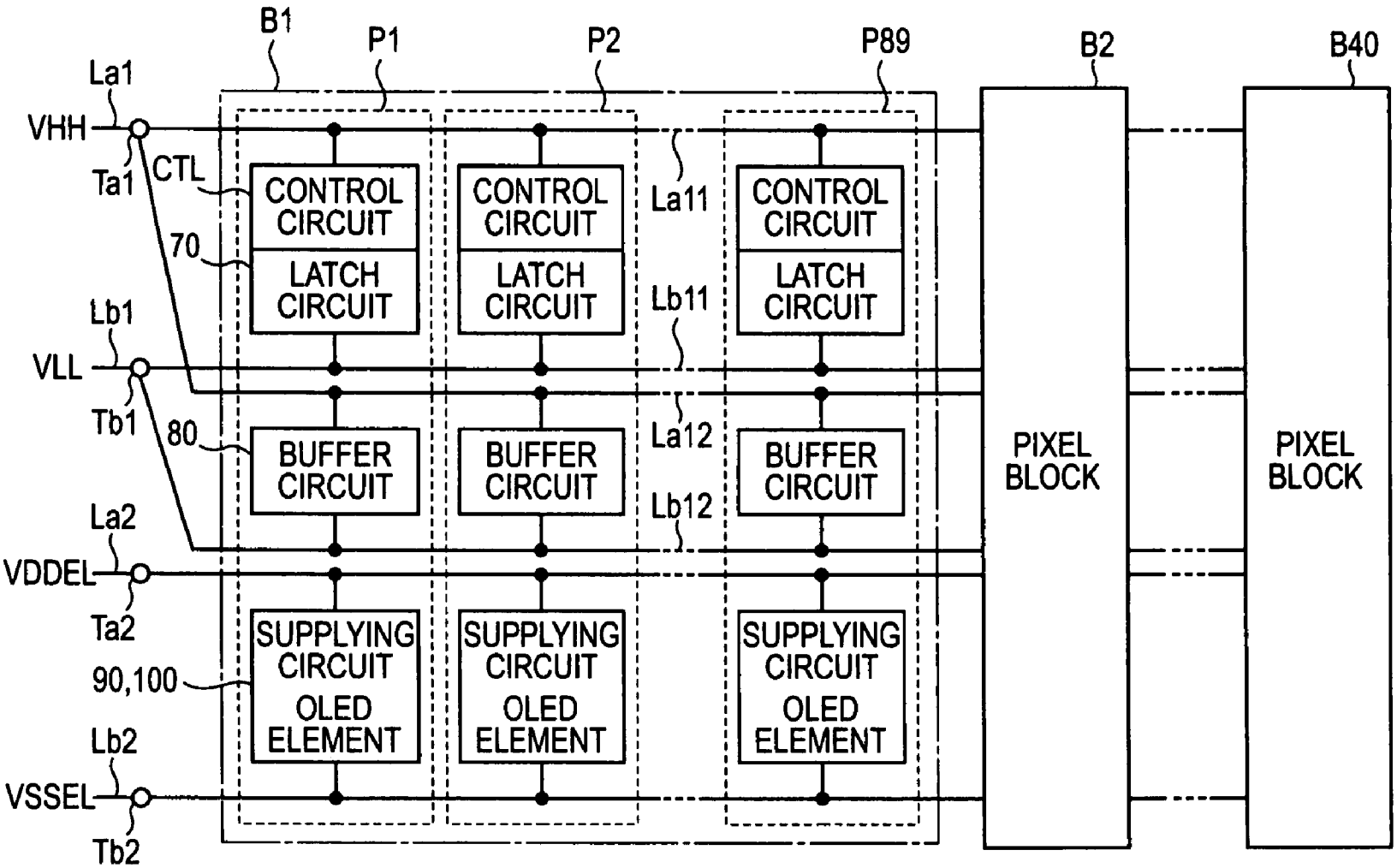
FIG. 7 is an explanatory view showing the specific construction of logic power lines La1 and Lb1 and driving power lines La2 and Lb2.
Figure 8:
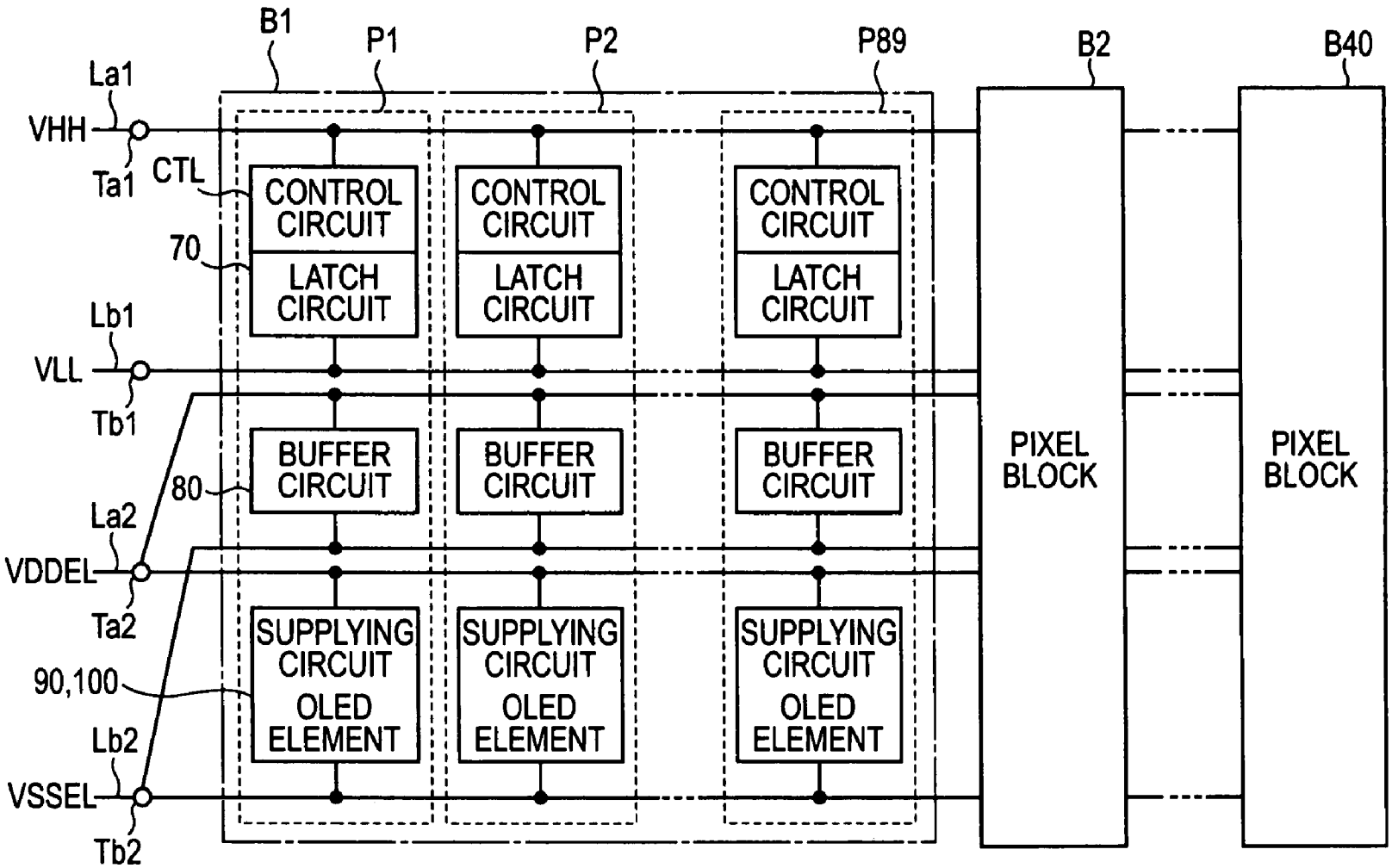
FIG. 8 is an explanatory view showing the specific construction of logic power lines La1 and Lb1 and driving power lines La2 and Lb2 according to a modification 1.

FIG. 7 shows a specific configuration of the logic power lines La1 and Lb1, and the driving power lines La2 and Lb2. As shown in FIG. 7, the driving power lines La2 and Lb2 are connected to the supplying circuit 90 of the respective pixel circuits P1 to P89 and the OLED element 100, and supply the second high-potential power signal VDDEL and the second low-potential power signal VSSEL.

Meanwhile, the logic power line La1 is branched into a first logic power line La11 and a second logic power line Lal2 at the supplying terminal Ta1. Further, the logic power line La1 is branched into a first logic power line Lb11 and a second logic power line Lb12 at the supplying terminal Tb1. The first logic power lines La11 and Lb11 are connected to the control circuits CTL and the latch circuits 70 of the respective pixel circuits P1 to P89, the second power lines La12 and Lb12 are connected to the buffer circuits 80 of the respective pixel circuits P1 to P89.

The reason why the power signals VHH and VLL are branched into the logic power lines La1 and Lb1 is as follows. In buffer circuit 80, at a time when a logic level of the latch circuit 70 is inverted, a current flows. The timing when a logic level is inverted is in synchronization with the time when the respective sampling signals SAM1 to SAM40 become active. That is, when a predetermined pixel block is selected, a current flows to each buffer circuit which is included in the corresponding pixel block at the timing when a corresponding sampling signal becomes active. Therefore, a large current flows at the timing when the sampling signals SAM1 to SAM40, respectively, become active. For example, the power line which supplies the first high-potential power signal VHH and the first low-potential power signal VLL has excessively low impedance. It would be ideal if the potentials of the first high-potential power signal VHH and the first low-potential power signal VLL do not change even when a large current flows to the buffer circuit 80.

However, in actuality, distribution resistance exists in the power lines. Because of this, when a large current flows to the buffer circuit 80, the potentials of the first high-potential power signal VHH and the first low-potential power signal VLL change. In particular, as shown in the embodiment, in the crosswise long head unit 10, distribution resistance due to the increase in the length of the power line should not be neglected. If the potentials of the first high-potential power signal VHH and the first low-potential power signal VLL change as such, the contents stored in the latch circuit 70 may be written again. Further, once the contents of the latch circuit 70 has been written again, a wrong logic level remains in the latch circuit 70 until the next writing period, thus the OLED element 100, which is to emit light, does not emit light, and the OLED element 100, which is not to emit light, emits light.

Accordingly, in the embodiment, the power line in the buffer circuit 80 and the latch circuit 70 is separated. As such, by branching the logic power lines La1 and Lb1 to supply the first high-potential power signal VHH and the first low-potential power signal VLL, when a large current flows to the buffer circuit 80, the changes in the potentials of the first power lines La 11 and Lb11 for logic can be suppressed even though the potential of the second logic power lines La 12 and Lb 12 changes. Therefore, the contents stored in the latch circuit 70 can be prevented from being written again due to the changes in the first high-potential power signal VHH and the first low-potential power signal VLL. This greatly improves the quality of the printing. A branching point can be located either inside the head unit 10 or inside the power circuit 40.

Further, it is preferable that the width of the power line be narrow in order to increase the integrated density of the power line. On the other hand, it is preferable that the width of the power line be wide in order to suppress the changes in the potentials of the first high-potential power signal VHH and the first low-potential power signal VLL. When the power lines La1 and Lb1 are branched as described above, it is possible to allow the changes in the electric potentials of the second logic power lines La12 and Lb12 to some degree. Thus, preferably, the widths of the first logic power lines La11 and Lb11 are set to be larger than the widths of the second logic power lines La12 and Lb12. By setting as above, it is possible to effectively utilize an area allocated to the power lines and to reliably retain the contents stored in the latch circuit 70.

Modification of Light-Emitting Device

Hereinafter, modifications of the light-emitting device will be described.

Modification 1

Although the buffer circuit 80 in the aforementioned light-emitting device is connected to the second logic power lines La12 and Lb12, through which the first high-potential power signal VHH and the first low-potential power signal VLL are supplied thereto in the embodiment, the second high-potential power signal VDDEL and the second low-potential power signal VSSEL may be supplied to the buffer circuit 80. However, in this case, even though the buffer circuit 80 is connected to the driving power lines La2 and Lb2, it is preferable that the changes in the potentials of the first high-potential power signal VHH and the first low-potential power signal VLL do not exceed threshold values of the driving transistor 93 and the control transistor 94.

Modification 2

Even though the latch circuit 70 is provided in the pixel circuit P in the above described embodiment and the first modification, a storing unit can be constructed by using a capacitive element instead of the latch circuit 70.

Figure 9:
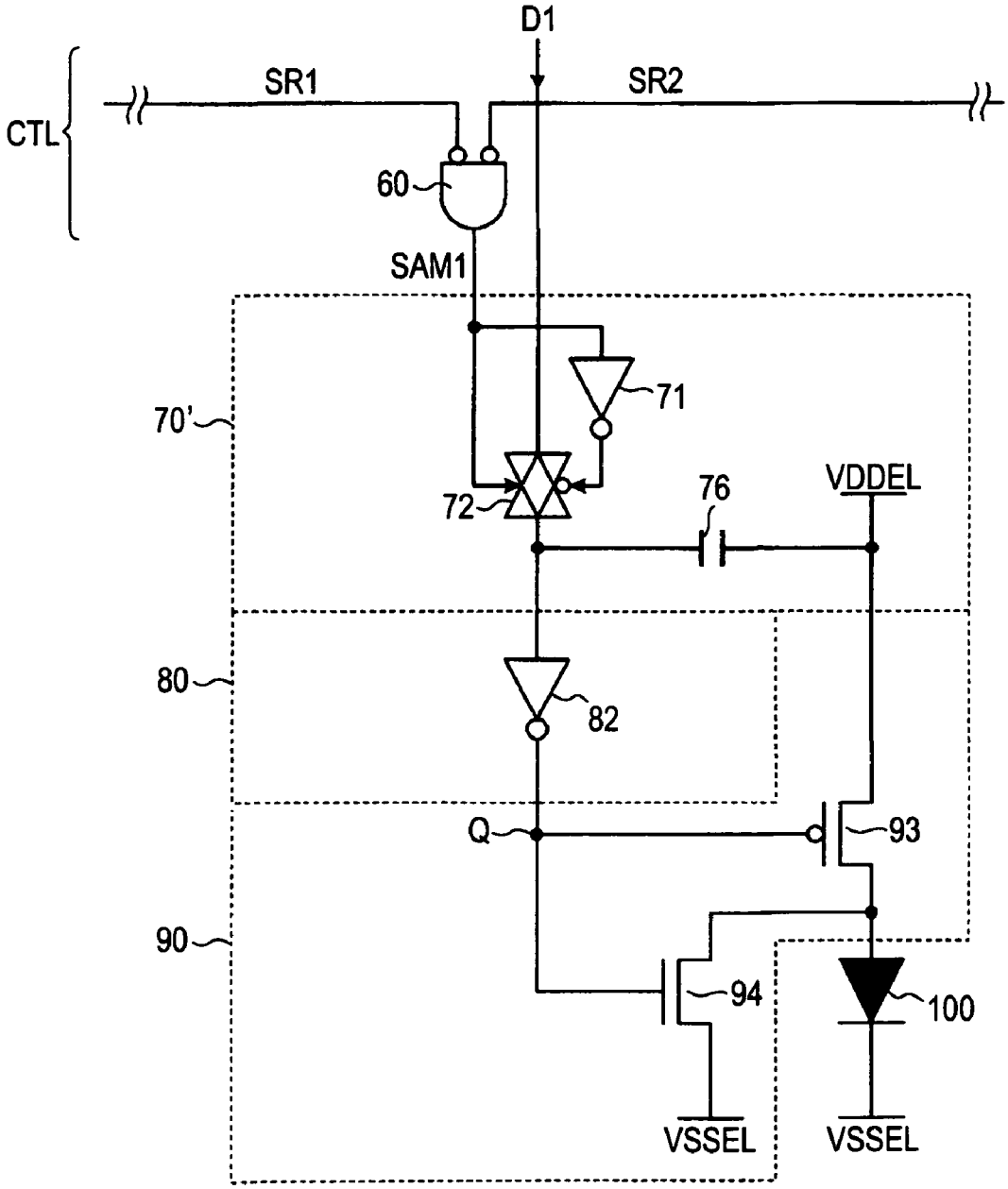
FIG. 9 is a circuit diagram of a pixel circuit according to a modification 2.

FIG. 9 is a circuit diagram showing a configuration of the pixel circuit P according to a second modification. As shown in FIG. 9, the pixel circuit P includes a capacitive element 76 between the gate of the driving transistor 93 and the second high-potential power signal VDDEL. Therefore, while a logic level of the data signal D1 is written in the capacitive element 75 for a period of time for which the sampling signal SAM1 is active, the logic level written while the sampling signal is not active is maintained. Accordingly, the capacitive element 76 acts as a storing unit 70'.

Even in this case, since the inverter 82 which functions as the buffer circuit 80 controls the gate of the driving transistor 93, it is possible to reliably control on/off of the driving transistor 93.

Image Forming Apparatus

Figure 10:
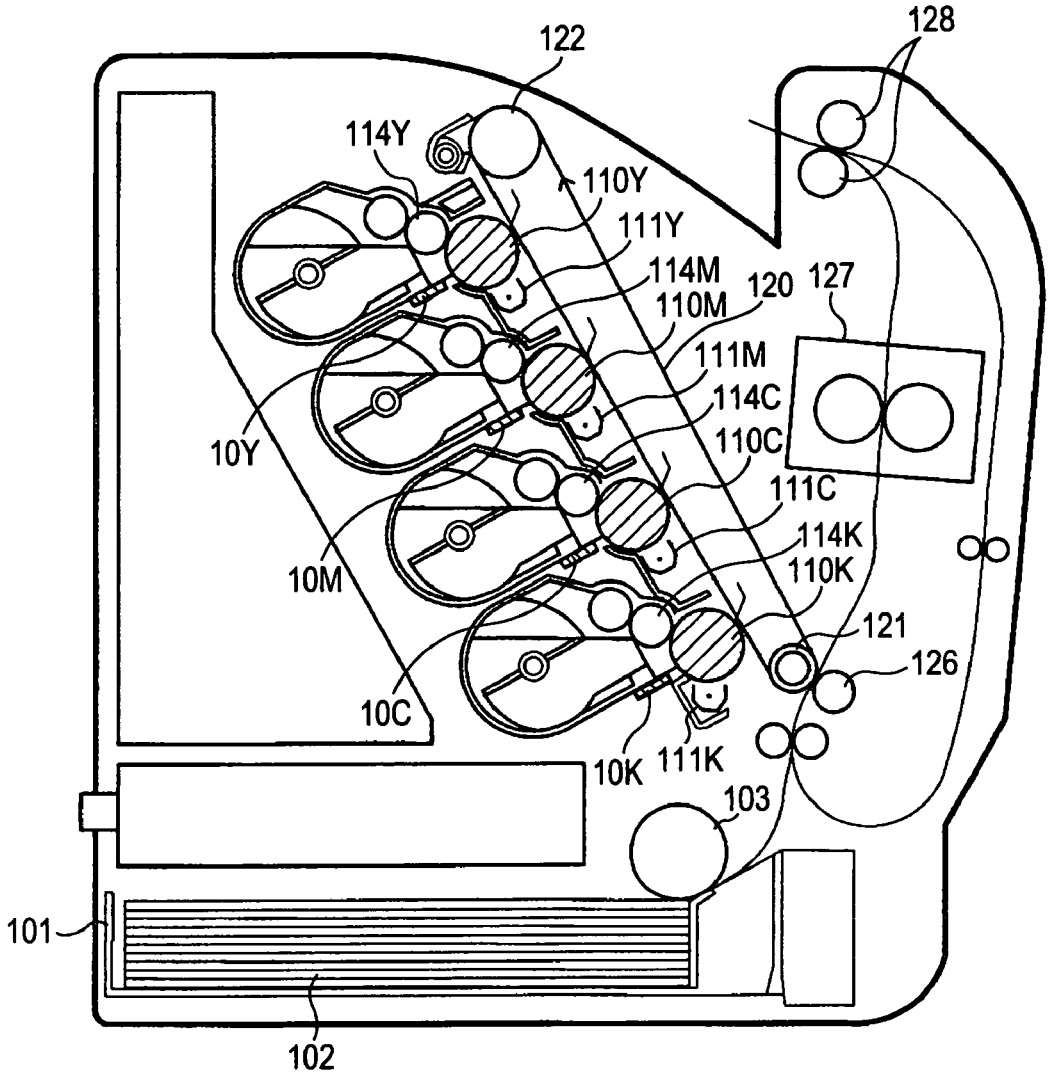
FIG. 10 is a longitudinal side view showing an example of an image forming apparatus.

FIG. 10 is a longitudinal side view showing an example of an image forming apparatus using the aforementioned head unit 10. The image forming apparatus is constituted as a tandem type image forming apparatus in which four organic EL array exposing heads 10K, 10C, 10M, and 10Y having the same configuration are arranged at exposure positions of four corresponding photoconductor drums (image carriers) 110K, 110C, 110M, and 110Y having the same configuration. The organic EL array exposing heads 10K, 10C, 10M, and 10Y are configured as the aforementioned head unit 10.

As shown in FIG. 10, the image forming apparatus includes a driving roller 121, a driven roller 122, and an intermediate transfer belt 120 which is driven to be circulated in the direction indicated by an arrow in FIG. 10. The photoconductor drums 10K, 110C, 110M, and 10Y each having a photosensitive layer on its outer peripheral surface are arranged with a predetermined gap with respect to the intermediate transfer belt 120. The characters K, C, M, and Y added to the reference numerals indicate black, cyan, magenta, and yellow, respectively. Thus, they indicate the photoconductor drums for black, cyan, magenta, and yellow, respectively. These reference numerals are also applied to the other kinds of members.

The photoconductor drums 110K, 110C, 110M, and 110Y are driven to be rotated in synchronization with the driving of the intermediate transfer belt 120.

A charging unit (a corona charger) 111 (K, C, M, and Y) for uniformly charging the outer peripheral surface of the photoconductor drum 110 (K, C, M, and Y) and the organic EL array exposing head 10 of the invention (K, C, M, and Y) for sequentially line-scanning the outer peripheral surface uniformly charged by the charging unit 111 (K, C, M, and Y) in synchronization with the rotation of the photoconductor drum 110 (K, C, M, and Y) are arranged around each photoconductor drum 110 (K, C, M, and Y).

In addition, the image forming apparatus includes a developing unit 114 (K, C, M, and Y) which applies toner, serving as a developer, onto an electrostatic latent image formed by the organic EL array exposing head 10 (K, C, M, and Y) to thereby convert the image into a visible image (toner image).

In this case, each EL array exposing head 10 (K, C, M, and Y) is arranged such that the arrayed direction of the EL array exposing head 10 (K, C, M, and Y) is aligned with the bus line of each photoconductor drum 110 (K, C, M, and Y). Further, the light emission energy peak wavelength of each EL array exposing head 10 (K, C, M, and Y) is set to coincide approximately with the sensitivity peak wavelength of each photoconductor drum 110 (K, C, M, and Y).

In the developing unit 114 (K, C, M, and Y), for example, a non-magnetic single-component toner is used as the developer. The single-component developer is conveyed to a developing roller by, for example, a supplying roller. The film thickness of the developer adhered to the surface of the developing roller is regulated by a control blade. Then, the developing roller is brought into contact with or pressed against the photoconductor drum 110 (K, C, M, and Y), so as to cause the developer to be adhered thereto depending on the potential level on the photoconductor drum 110 (K, C, M, and Y), so that development into a toner image is performed.

The four toner images of black, cyan, magenta, and yellow generated by such four single-color toner image forming stations are primarily transferred sequentially onto the intermediate transfer belt 120, and sequentially overlaid onto the intermediate transfer belt 120 so as to become a full-color toner. A recording medium 102 is fed by a pick-up roller one by one from the sheet feed cassette 101 to be transferred onto a second transfer roller 126. The full-color toner image generated by overlaying these single-color toner images on the intermediate transfer belt 120 is secondarily transferred onto the recording medium 102, such as a paper in the secondary transfer roller 126. The image is fixed on the recording medium 102 during the passage through a pair of fixing rollers 127, serving as a fixing unit. The recording medium 102 is then ejected through a pair of sheet ejection rollers 128 onto a sheet ejection tray provided on the top of the device.

In this way, since the image forming apparatus shown in FIG. 9 utilizes the organic EL array as a writing unit, it is easier to miniaturize the device than in a case in which a laser scan optical system is utilized.

Hereinafter, the image forming apparatus according to another embodiment of the invention will be described.

Figure 11:
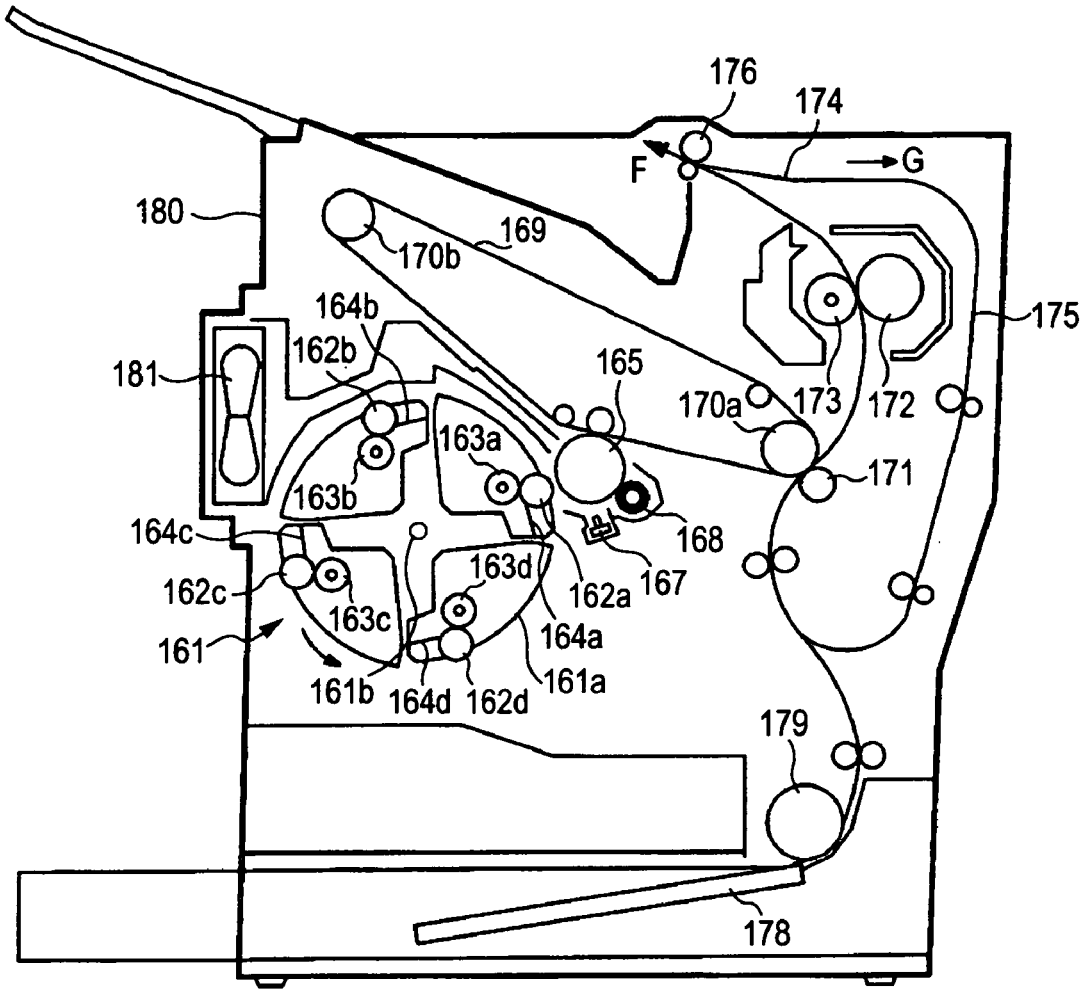
FIG. 11 is a longitudinal side view showing another example of the image forming apparatus.

FIG. 11 is a longitudinal side view showing another example of the image forming apparatus. In FIG. 11, the main components of the image forming apparatus include a developing unit 161 having rotary arrangement, a photoconductor drum 165 functioning as an image carrier, an exposing head 167 in which an organic EL array is provided, an intermediate transfer belt 169, a sheet conveying path 174, a heating roller 172 of a fixing device, and a sheet feeding tray 178. The exposing head 167 is configured by the aforementioned head unit 10.

In the developing unit 161, a developing rotary 161 a rotates counter-clockwise about a shaft 161*b*. The inside of the developing rotary 161*a* is divided into four sections, each being provided with one of the image forming units for the four colors of yellow (Y), cyan (C), magenta (M), and black (K). Developing rollers 162*a* to 162*d* and toner supply rollers 163*a* to 163*d* are respectively arranged in each of the image forming units for four colors. Control blades 164*a* to 164*d* regulate the toner thickness to a predetermined value.

The photoconductor drum 165 is charged by the charging unit 168, and is driven by a driving motor (not shown), such as a stepping motor, in a direction opposite to the rotating direction of the developing roller 162*a*. The intermediate transfer belt 169 is stretched over a driving roller 170*a* and a driven roller 170*b*. The driving roller 170*a* is linked to a driving motor of the photoconductor drum 165 so as to transmit power to the intermediate transfer belt 169. When this driving motor operates, the driving roller 170*a* of the intermediate transfer belt 169 rotates in the direction opposite to the rotating direction of the photoconductor drum 165.

The sheet conveying path 174 is provided with a plurality of conveying rollers and a pair of sheet ejection rollers 176 so as to convey a paper. An image (toner image) on one side carried by the intermediate transfer belt 169 is transferred to one side of the paper at the position of the secondary transfer roller 171. The secondary transfer roller 171 is brought into contact with or separated from the intermediate transfer belt 169 by a clutch mechanism. When the clutch operates, the secondary transfer roller 171 is brought into contact with the intermediate transfer belt 169, thus the image is transferred to the paper.

Next, the paper carrying the image transferred as described above is subjected to a fixing process in the fixing device having a fixing heater. The fixing device is provided with a heating roller 172 and a pressure roller 173. The paper after the fixing process is drawn into the pair of sheet ejection rollers 176 to travel in the direction indicated by an arrow F. In this state, when the pair of sheet ejection rollers 176 rotate reversely, the paper travels reversely in the direction indicated by an arrow G through a sheet conveying path 175 for double-side printing. The paper is drawn out by a pick-up roller 179 one by one from the sheet feed tray 178.

The driving motor used for driving the conveying rollers in the sheet conveying path is, for example, a low-speed brushless motor. A stepping motor is used for the intermediate transfer belt 169 because of the necessity for color shift correction. Each of the motors is controlled by signals provided from a controller, which is not shown.

In the state shown in FIG. 11, an electrostatic latent image of yellow (Y) is formed on the photoconductor drum 165, and a high voltage is applied to the developing roller 128. As a result, a yellow image is formed on the photoconductor drum 165. When the yellow image at both the back side and the front side are carried onto the intermediate transfer belt 169, the developing rotary 161*a* rotates by 90 degrees.

The intermediate transfer belt 169 makes one turn to come back to the position of the photoconductor drum 165. Next, cyan (C) images at two sides are formed on the photoconductor drum 165. These images are then overlaid on the yellow image carried on the intermediate transfer belt 169. Thereafter, similar processes are repeated. That is, the developing rotary 161 rotates by 90 degrees, and then the intermediate transfer belt 169 makes one turn after carrying the images onto the intermediate transfer belt 169.

In order to carry all four color images onto the intermediate transfer belt 169, the intermediate transfer belt 169 rotates four times, and the rotating position is then controlled to transfer the images onto a paper at the position of the secondary transfer roller 171. A paper fed from the sheet feeding tray 178 is conveyed along the conveying path 174, and then one of the color images is transferred onto one side of the paper at the position of the secondary transfer roller 171. The paper having the transferred image on one side thereof is reversed by the pair of sheet ejection rollers 176 as described above, and then waits in the conveying path. Thereafter, at an appropriate timing, the paper is conveyed to the position of the secondary transfer roller 171, so that the other color image is transferred onto the other side. A housing 180 is provided with an exhaust fan 181.

In addition, the aforementioned light-emitting device may be applied to an image reading apparatus. The image reading apparatus includes a light-emitting part which irradiates light onto the targeted object, and a scan part which reads the light reflected from the targeted object to output image signals. The aforementioned light-emitting device is utilized in the light-emitting part. Here, the light-emitting part may be movable and the scan part may be fixed, or the light-emitting part and the scan part may be integrated to move. In the latter case, the scan part and the light-emitting part may be formed on one substrate, by constructing the scan part using a TFT. A scanner and a barcode reader fall under such an image reading apparatus.

What is claimed is:

1. A pixel circuit comprising:

a light-emitting element which emits light having the intensity corresponding to an amount of a driving current;

a driving transistor which supplies the driving current to the light-emitting element;

a storing circuit which writes a data signal instructing the light-emitting brightness of the light-emitting element during a writing period of time to store the data signal; and a buffer circuit which supplies a signal output from the storing circuit to the driving transistor, wherein among transistors constituting the buffer circuit, the size of an output transistor used in an output stage thereof is smaller than the size of the driving transistor.

2. The pixel circuit of claim 1, wherein the size of the output transistor is set such that a rising time of an output signal of the buffer circuit is shorter than a period of time from a predetermined writing time to a next writing time.

3. The pixel circuit of claim 1, wherein the buffer circuit is composed of an inverter.

4. A light-emitting device comprising:

a plurality of the pixel circuits of claim 1;

a plurality of data lines which supplies data signals to the plurality of pixel circuits; and a driving circuit which supplies a signal instructing the writing period of time to the storing circuit.

5. The light-emitting device of claim 4, further comprising:

a main power line which is branched into a first power wiring line and a second power wiring line at a connection point and supplies power signals, wherein the first power wiring line is connected to the storing circuit, and the second power wiring line is connected to the buffer circuit.

6. The light-emitting device of claim 5, wherein the width of the first power wiring line is larger than that of the second power wiring line.

7. The light-emitting device of claim 4, wherein the buffer circuit and the driving transistor are connected to the same power line.

8. An image forming apparatus comprising:

photoconductors on which images are formed by irradiation of light; and a head unit that forms the images by irradiating light onto the photoconductors, wherein the light-emitting device of claim 4 is used in the head unit.

* * * * *